United States Patent [19]

Valdo

[11] 4,022,614

[45] * May 10, 1977

[54] METHOD OF REFINING ALUMINUM-SILICON ALLOYS

[75] Inventor: Alex R. Valdo, Phoenix, Ariz.

[73] Assignee: Ethyl Corporation, Richmond, Va.

[ * ] Notice: The portion of the term of this patent subsequent to May 25, 1993, has been disclaimed.

[22] Filed: Mar. 22, 1976

[21] Appl. No.: 669,310

Related U.S. Application Data

[63] Continuation-in-part of Ser. No. 612,393, Sept. 12, 1975, Pat. No. 3,958,979, which is a continuation-in-part of Ser. No. 424,842, Dec. 14, 1973, abandoned, which is a continuation of Ser. No. 212,378, Dec. 27, 1971, abandoned, which is a continuation of Ser. No. 32,326, April 27, 1970, abandoned, which is a continuation-in-part of Ser. No. 26,751, April 8, 1970, abandoned.

[52] U.S. Cl. ..... 75/63; 75/68 A; 75/93 AC; 75/135

[51] Int. Cl.[2] ..... C22B 21/06

[58] Field of Search ..... 75/68 R, 68 A, 63, 93 AC, 75/135

[56] References Cited

UNITED STATES PATENTS

| | | | |
|---|---|---|---|
| 1,550,192 | 8/1925 | Wild | 75/68 R |
| 3,436,212 | 4/1969 | Hess | 75/68 R |
| 3,775,092 | 11/1973 | Brusakor et al. | 75/93 AC |
| 3,958,979 | 5/1976 | Valdo | 75/68 A |

*Primary Examiner*—M. J. Andrews
*Attorney, Agent, or Firm*—Donald L. Johnson; John F. Sieberth; Paul H. Leonard

[57] ABSTRACT

Molten aluminum-silicon alloys or aluminum base alloys containing substantial amounts of silicon which contain deleterious amounts of titanium are refined by treatment with a fluoride flux less dense than the alloy and having a boiling point above the liquidus temperature of the alloy. The alloy is first prepared or formed in a suitable furnace. The molten alloy formed therein is transferred to a ladle via a tap hole in the furnace. While the molten alloy is in the ladle at the tap hole area, solid granular flux is added thereto in a sufficient amount to reduce but not entirely eliminate the titanium content of the alloy. Subsequently, the alloy and flux are separated. A second fluxing treatment may be performed after the ladle has been removed from the tapping area.

7 Claims, No Drawings

METHOD OF REFINING ALUMINUM-SILICON ALLOYS

CROSS REFERENCES TO RELATED APPLICATIONS

This is a continuation-in-part of application Ser. No. 612,939, filed Sept. 12, 1975, now U.S. Pat. No. 3,958,979, which is a continuation-in-part of application Ser. No. 424,842, filed Dec. 14, 1973, now abandoned, which in turn is a continuation of application Ser. No. 212,378, filed Dec. 27, 1971, now abandoned, which is a continuation of application Ser. No. 32,326, filed Apr. 27, 1970, now abandoned, which in turn is a continuation-in-part of application Ser. No. 26,751, filed Apr. 8, 1970, now abandoned.

BACKGROUND OF THE INVENTION

The present invention is in the field of non-ferrous metallurgy and relates particularly to the refining of aluminum-silicon alloys.

Titanium, carbon and/or oxygen cause deleterious effects to the processability, corrosion resistance and other desirable characteristics of aluminum. It is therefore important that their content be reduced to an acceptable level.

The present invention provides an economical method for removing these undesirable elements, titanium, carbon and oxygen, and other impurities from aluminum-silicon alloys or aluminum base alloys containing substantial amounts of silicon. It is considerably less costly than other known pyrometallurgical or extractive metallurgical processes.

Another advantage of the present invention over prior art processes is that utilization of residual heat is permitted.

Another advantage of the present invention is that the fluxes may be recycled.

SUMMARY OF THE INVENTION

The present invention relates primarily to a method for refining aluminum-silicon alloys for removing titanium, carbon and oxygen and other impurities. The invention is especially suitable for reducing, but not entirely eliminating, titanium in the alloy. An aluminum-silicon alloy may be prepared or manufactured by any suitable process. Normally, some type of furnace is used to produce the molten alloy. The invention is particularly adapted for use with an aluminum-silicon alloy prepared from a raw ore. Such an alloy usually contains undesirable amounts of impurities, especially titanium. After the alloy is molten, it is transferred to a ladle via a tap hole in the furnace. In carrying out the invention, a mixture of fluxes or a standard flux is added to the molten aluminum-silicon alloy containing the undesired impurities while the alloy is in the ladle at the tap hole and while the alloy is in a molten condition. The flux is preferably in solid or granular form. The resulting turbulence and convection from adding the flux to the molten alloy provides sufficient stirring so that no mechanical stirring is required. A mixture of flux and impurities is formed and allowed to collect on the surface. Removal of the flux and impurities is accomplished by decanting, siphoning or allowing the impurities to solidify wherein they can readily be removed. The flux may then be cleaned by filtering and recycled.

If desired or necessary, a second fluxing may be carried out after the ladle containing the molten alloy has been removed from the tapping area. Such second fluxing is performed while the alloy is still in a molten condition.

The flux or flux composition may be a material such as cryolite or may be a mixture of an aluminum fluoride compound with one or more of a sodium, lithium, or potassium chloride or fluoride. An example of a preferred composition is as follows:

| | |
|---|---|
| Cryolite | 5% - 100% |
| Sodium chloride | 0% - 95% |
| Potassium chloride | 0% - 95% |

These percentages are by weight.

Some examples of other suitable flux compositions are:

1. $LiF—AlF_3$ (85% LiF—15% $AlF_3$; 64% LiF—36% $AlF_3$)
2. $LiF—NaF—AlF_3$ (39.1% LiF—39.1% NaF—21.8% $AlF_3$)
3. $NaF—AlF_3$ (53% NaF — 47% $AlF_3$)
4. $NaF—KF—AlF_3$ (32% NaF — 48% KF — 20% $AlF_3$)
5. $KF—AlF_3$ (55% KF — 45% $AlF_3$)
6. $KF—LiF—AlF_3$ (47.5% KF — 47.5% LiF — 5% $AlF_3$)
7. $LiCl—KCl—Na_3AlF_6$ (48% LiCl — 32% KCl — 20% $Na_3AlF_6$)
8. $LiCl—NaCl—Na_3AlF_6$ (56% LiCl — 24% NaCl — 20% $Na_3AlF_6$)

The foregoing compositions are shown in mole-percent.

Other suitable fluxes may be used without departing from the scope of the invention. The flux must be one, however, which does not excessively contaminate the aluminum-silicon alloy or undergo a chemical reaction with the alloy to introduce undesirable metal impurities. An ideal flux is one which has a boiling point above the liquidus temperature of the alloy. A boiling point of about 200° above the liquidus temperature of the molten aluminum-silicon alloy is particularly desirable. In an aluminum-silicon alloy having a low or minimal viscosity at 1200° C or higher, a flux having a boiling point of about 1400° C would be especially useful.

An aluminum-silicon alloy containing about 40% by weight of silicon is adequately molten around 1000° C. This is a desirable fluxing temperature since fuming is excessive if the flux is heated above 1000° C.

A preferred flux is one which has a sufficiently high boiling point to permit use of a temperature at which the alloy is sufficiently liquid and which promotes rapid and efficient separation of the impurities into flux phase away from the alloy phase. The process is operated at a temperature which provides the desired low or minimal viscosity to promote phase separation and which fuming is not excessive.

DESCRIPTION OF THE PREFERRED EMBODIMENT OF THE INVENTION

A flux composition comprising cryolite, sodium chloride and potassium chloride has been found to be particularly suitable for reducing titanium, carbon and oxygen impurities in aluminum-silicon alloys. In one preferred form of the invention, a granular flux compositon comprising 47.5 weight percent NaCl, 47.5 weight percent KCl, and 5 weight percent cryolite is added to a molten silicon alloy containing impurities of titanium, carbon and oxygen at a temperature below the lowest boiling point of the flux ingredients. The molten mixture of flux and alloy is stirred via turbulence and convection and a mixture of flux plus impurities is allowed to form on the surface. The flux impurities are then removed by decanting or by allowing the mixture of flux and impurities to solidify and then removing therefrom. Preferably, the flux is then cleaned and recycled. A preferred ratio of flux:alloy is 0.2:1. Even lesser amounts of flux may be adequate, e.g., ratio of flux to alloy of about 0.02:1, especially when a second fluxing step is employed. Any other suitable ratio of flux to alloy may be used. It is only necessary that sufficient flux be used to obtain the desired decrease in or removal of impurities. Amounts required will vary depending upon amounts of impurities in alloy and types of flux used.

Fluxes or flux compositions which have been found to be particularly preferable are those comprising cryolite, sodium chloride and potassium chloride wherein the compounds are distributed in weight percent from about 5–20%, 40–47.5%, and 40–47.5%, respectively.

A variety of tests have been made showing the large reduction of impurities in aluminum-silicon alloys.

EXAMPLE I

An aluminum-silicon alloy containing impurities as follows was tested with various flux compositions:

| Elements | Wt % by X-Ray Fluorescence (XRF) |
|---|---|
| Al | 62.7 |
| Si | 23.4 |
| Fe | 2.8 |
| Ti | 3.3 |
| C | 3.6* |
| O | 3.4** |
| Total | 99.2 |

*Leco Furnace Analysis
**Neutron Activation Analysis

In the test procedure, 100 grams of the aluminum-silicon alloy was charged into a graphite crucible in an electric resistance furnace. Previous tests indicated that the best fluid temperature or temperature of minimum viscosity was about 1000°–1100° C or 1200° C in some instances, depending upon the particular alloy composition. One hundred grams of each of several fluxes were added to the molten alloy, the mixture of alloy and flux was heated to the desired temperature, stirred several times and allowed to cool slowly in the crucible. The solidified flux was separated from the alloy very easily and cleanly. The alloy was then analyzed by X-ray Fluorescence. Carbon content was determined by the Leco Combustion or Furnace Method and oxygen content was determined by the Neutron Activation Method. These are all standard methods of analyses well known to those skilled in the analytical art. The result of these tests are shown in Table I.

TABLE I

| Run No. | Flux | Melt Temp., ° C | Flux Treatments for Ti, C and O Removal — Percentages by Weight x-Ray Fluorescence: Al | Si | Fe | Ti | C** | O*** |
|---|---|---|---|---|---|---|---|---|
| 1* | — | — | 62.7 | 23.4 | 2.8 | 3.3 | 3.6 | 3.4 |
| 2 | (a) | 1175–1400 | 60.4 | 22.4 | 3.7 | 2.0 | 1.14 | 2.89 |
| 3 | (b) | 1155 | 65.5 | 22.1 | 2.4 | 2.0 | 0.82 | 0.61 |
| 4 | (b) | 1100 | 65.6 | 21.2 | 2.6 | 1.7 | 0.54 | 0.81 |
| 5 | (c) | 1110 | 69.5 | 21.1 | 2.1 | 1.4 | 0.1 | 0.43 |
| 6 | (c) | 1105 | 68.6 | 23.9 | 3.4 | 2.0 | 0.2 | 0.57 |
| 7 | (d) | 1100 | 70.8 | 22.4 | 2.6 | 1.6 | 2.62 | 0.62 |
| 8 | (d) | 1200 | 63.6 | 22.5 | 2.9 | 1.8 | 0.90 | 1.63 |

*Control Sample
**Leco Furnace Method
***Neutron Activation Method
(a) $Na_3AlF_6$
(b) 47.5% NaCl + 47.5% KCl + 5% $Na_3AlF_6$
(c) 45% NaCl + 45% KCl + 10% $Na_3AlF_6$
(d) 40% NaCl + 40% KCl + 20% $Na_3AlF_6$

EXAMPLE II

An alloy, comprising 63 percent aluminum, 33 percent silicon, 2.6 percent iron and 1.6 percent titanium was treated with a flux comprising 40 percent sodium chloride, 40 percent potassium chloride and 20 percent cryolite. All percentages of alloy are by weight by X-ray fluorescence. Percentages of flux ingredients are by weight. One hundred grams each of alloy and flux were heated to a temperature of 1150° C in a graphite crucible, stirred several times, and allowed to cool slowly in the crucible. The solidified flux was separated from the alloy very easily and cleanly. X-ray fluorescence analyses of the alloy are as follows:

TABLE II

| Runs | Weight % Al | Si | Fe | Ti |
|---|---|---|---|---|
| Control | 63.0 | 33.0 | 2.6 | 1.6 |
| (1) | 59.8 | 31.6 | 2.1 | 0.6 |
| (2) | 62.1 | 28.9 | 2.3 | 0.5 |

Additional tests were run wherein the flux:alloy ratios and flux compositions were varied. The test procedures were substantially identical to those reported hereinabove, mainly, heating and melting in a graphite crucible to a temperature of 1150° C, stirring several times, then slowly cooling the melt to ambient temperature. The results of these tests are recorded hereinafter in Examples III–V.

EXAMPLE III

One hundred grams of flux (40 percent sodium chloride, 40 percent potassium chloride and 20 percent cryolite—percent by weight) to 50 grams of alloy reduced titanium content of the alloy approximately 60 percent by weight.

EXAMPLE IV

A 1:1 mixture of flux (47.5 percent sodium chloride, 47.5 percent potassium chloride, and 5 percent cryolite — percent by weight) to alloy was used. Again, approximately 60 percent of the titanium was removed.

EXAMPLE V

A 1:1 mixture of flux (45 percent sodium chloride, 45 percent potassium chloride and 10 percent cryolite — percent by weight) to alloy was used. Again, approximately 60 percent of the titanium was removed.

The results of Example III, IV and V are set forth hereinafter in Table III:

TABLE III

| | Weight % | | | |
|---|---|---|---|---|
| | Al | Si | Fe | Ti |
| Control | 63.0 | 33.0 | 2.6 | 1.6 |
| Ex. III | 59.0 | 30.9 | 2.5 | 0.6 |
| Ex. IV | 59.8 | 33.0 | 2.7 | 0.6 |
| Ex. V | 58.4 | 32.3 | 2.5 | 0.6 |

EXAMPLE VI

The procedures of the foregoing Examples III–V are carried out except that the flux used is 85% LiF and 15% $AlF_3$ (mole percent) and the ratio of flux to alloy is 1:1. Titanium removal is effective.

EXAMPLE VII

The procedures of Example VI are followed except that the flux used is 48% LiCl, 32% KCl and 20% $Na_3AlF_6$ (mole percent). Similar results are obtained.

EXAMPLE VIII

The procedure of Example VI is followed except that the flux used is 47.5% KF, 47.5% LiF and 5% $AlF_3$ (mole percent). Comparable results are obtained.

EXAMPLE IX

The procedure of Example VI is followed except that the following fluxes are used in individual runs (percentages by weight)

a. 40% NaF, 40% KF and 20% $Na_3AlF_6$
b. 45% NaF, 45% KF and 10% $Na_3AlF_6$
c. 47.5% NaF, 47.5% KF and 5% $Na_3AlF_6$ Comparable results are obtained.

A series of tests were made wherein no flux was used at relatively high temperatures and a flux was used at relatively lower temperatures. When the aluminum alloy was melted at 1300° C and 1450° C, without flux additions, there was approximately a 66% decrease in titanium content. The same magnitude in decrease was noted when the alloy was melted at 900° C and 1025° C with a 1:1 flux mixture, and at 1150° C with a 0.5:1 flux to alloy mixture. The flux used in the test was 45% sodium chloride, 45% potassium chloride and 10% cryolite, percentages by weight. The results of these tests are set forth hereinafter in Table IV.

TABLE IV

| Run | Al-Si Alloy - Refining | | | Ti |
|---|---|---|---|---|
| | Al | Si | Fe | |
| 1 | 63.0 | 33.0 | 2.6 | 1.6 |
| 2 | 59.2 | 30.0 | 2.5 | 0.5 |
| 3 | 57.3 | 34.2 | 2.7 | 0.5 |
| 4 | 64.9 | 31.3 | 2.5 | 0.5 |

TABLE IV-continued

| Run | Al-Si Alloy - Refining | | | Ti |
|---|---|---|---|---|
| | Al | Si | Fe | |
| 5 | 60.8 | 33.2 | 2.7 | 0.5 |
| 6 | 61.1 | 34.1 | 2.7 | 0.5 |

NOTES:
(1) Control sample
(2)
(3) Melt temps. 1300° C–1450° C respectively - no flux
(4) Melt temps. 1025° C – 1:1 mixture - flux
(5) Melt temps. 900° C – 1:1 mixture - flux
(6) Melt temps. 1150° C – 0.5:1 mixture - flux From the foregoing examples it can readily be seen that the addition of a flux to a molten aluminum-silicon alloy provides a convenient means for reducing the titanium, carbon and oxygen content of aluminum-silicon alloys, therefore considerably enhancing the value of such alloys. Table IV, in particular, illustrates the effectiveness of the use of a flux in reducing titanium content at substantially lower temperatures, than otherwise would be required.

From the foregoing examples it is also seen that the impure aluminum base alloy or aluminum-silicon alloy contains at least about 23 percent (23.4%) silicon and that titanium is present in an amount of at least about 1.6 percent.

EXAMPLE X

A series of alloy clean-up runs were made in a 300 lb. capacity, gas fired Lindberg furnace. Various amounts and sizes of aluminum-silicon alloy were used as furnace feed. In charging the furnace, the crucible was initially charged with a salt flux of 47.5% NaCl, 47.5% KCl and 5% cryolite. About 0.2 lbs. of flux per lb. of alloy to be melted was used. As much alloy as the crucible would hold was loaded as compactly as possible on top of the flux. Initially, only about 125 lbs. of alloy could be charged.

Operating procedure was as follows:

Firing and Controlling the Furnace

1. The overhead exhaust fan was switched on.
2. The two gas line valves were opened.
3. The combustion blower was started.
4. The control switch was turned to on.
5. The pilot burners were checked for correct positioning (they fall out when the metal is poured).
6. The Pilots Proven green button was held down until the green light came on. If the light did not come on in a minute, the air flow to the pilot burners had to be adjusted.
7. After the pilot burners were burning, the control set point was positioned above the room temperature reading.
8. The gas was then turned on with a lever switch near the gas line valves. This switch had to be thrown several times before the gas would come on.
9. The temperature of the melt was taken with an optical pyrometer and kept below 1800° F. The temperature of the bottom of the crucible was read through a view hole. The temperature was kept below 2400° F so as not to crack the crucible. When one of these temperatures reached its limit, the gas was turned off by turning the controller set point below the room temperature reading.

Melting the Alloy

As the initial charge melted, more alloy was added until a predetermined amount had been loaded. When the alloy was molten enough, it was stirred with a ladle washed iron rod and a temperature reading was taken on the exposed hot metal. The temperature was usually about 1400° F. From this point, it took 1½ to 2 hours for the alloy to completely melt. When the alloy had completely melted, the temperature of the metal had usually reached about 1600° F, which was the peak temperature since the dross was soon removed. The dross formed a fairly thick (6–12 inch) layer of mealy substance which sometimes contained larger chunks of slag that would not melt.

Drossing

The dross and chunks of slag were removed with a drossing tool (a slotted iron ladle) which was coated with ladle wash and dried prior to using to prevent its dissolving in the melt. The dross usually amounted to over 100 pounds and it required 30–45 minutes to remove it. Some dross adhered to the sides of the crucible and had to be scraped off before it could be removed. Some dross adhered to the bottom thus making it hard to remove. Stirring caused some of it to rise and the rest was removed after the metal was poured.

Gas fluxing

In an effort to remove sludge and prevent "gassing," or the forming of bubbles on the top of the poured metal, the melt was sometimes fluxed with chlorine gas. This was accomplished by connecting a 4 foot long 1 inch diameter graphite pipe to a $Cl_2$ cylinder via ¼ inch stainless steel tubing. The graphite pipe was heated for 15 minutes to remove moisture before being used. The graphite pipe, when connected, rested 6 inches to 1 foot off the bottom of the crucible. The valves on the $Cl_2$ cylinder were cracked until a flow could be felt through the tubes. The bubbling itself could not be seen because of the generation of smoke caused by the $Cl_2$ gas. The flow was adjusted until the metal did not splash above the furnace covering and the smoke was still abundant. The melt was gas fluxed for 5 minutes, then the dross and scum which had formed on the surface was removed.

Sampling

Before the metal was poured it was thoroughly stirred and sampled. A long-handled ladle which had been preheated with a gas burner was used to pour metal into a ring and plate sample mold. At least three of these samples were taken. One of these was crushed and ground and a 1 or 2 gram sample split out and submitted for analysis by atomic absorption.

Pouring

Three different types of molds were used: a 4 foot ×4 foot mold, 1 foot ×1 foot molds, and 30 lb. pig molds. The mold to be used was coated with ladle wash and preheated with a gas torch. When the 4 foot ×4 foot mold was used, it was set on a push cart and the metal was poured directy into it. When the smaller molds were used, the first half of the metal was poured into a marinite-lined iron trough, which reduced the falling distance of the metal through the air and directed the metal into the small molds. The trough was too tall for all the metal to be poured this way, so the second half of the metal had to be poured directly into the molds. The trough collected quite a bit (10–30 lbs.) of scummy metal, thus the metal was cleaner in the molds where the trough was used. This scummy metal was counted as dross and used as feed in the next run.

Removing sludge

Usually about 40 pounds of sludge or bottom dross remained in the crucible. This was scraped out into a container separate from the other materials.

Material balance

The metal, scummy metal, dross, and sludge were weighed and the weights recorded to be used in comparing runs and computing metal recoveries.

The results of the clean-up runs in the Lindberg furnace are shown in Tables V and VI. The tables set forth operating conditions, metal recoveries, product form and product analyses. As shown in Table VI, the titanium content of the feed alloy was effectively reduced.

TABLE V

Operating Data for Lindberg Runs

| Run No. | Feed (lb.) Alloy | Feed (lb.) Salt Flux | Product (lb.) Metal | Product (lb.) Dross | Product (lb.) Sludge | Gas Flux | Temp. ° F Peak | Temp. ° F Pour |
|---|---|---|---|---|---|---|---|---|
| 1 | 275 | 60 | 179 | 128 | 18 | $Cl_2$ | 1650 | 1550 |
| 2 | 300 | 60 | 213 | 130 | 9 | $Cl_2$ | 1680 | 1500 |
| 3 | 312 | 60 | 248 | 91 | 14 | $Cl_2$ | 1550 | 1500 |
| 4 | 333 | 60 | 190 | 155* | 29 | — | 1620 | 1600 |
| 5 | 329* | 60 | 173 | 148** | 48 | $Cl_2$ | 1540 | 1520 |
| 6 | 275 | 55 | 144 | 118*** | 40 | — | 1590 | 1560 |

*Includes 29 lb. of "scummy" metal
**Includes 10 lb. of "scummy" metal
***Includes 12 lb. of "scummy" metal

TABLE VI

Analytical Data For Lindberg Runs

| Run No. | Net Lbs. | Chem. Analysis, Wt. percent Al | Si | Fe | Ti | Total Metal |
|---|---|---|---|---|---|---|
| Feed | | 52.4 | 39.1 | 1.7 | 1.8 | 95.0 |
| 1* | 179 | 55.1 | 36.8 | 1.9 | 1.3 | 95.1 |
| 2* | 213 | 53.7 | 37.0 | 2.2 | 1.5 | 94.4 |
| 3* | 248 | 56.8 | 36.5 | 1.6 | 1.5 | 96.6 |
| 4** | 189 | 55.6 | 35.7 | 1.7 | 1.3 | 94.4 |
| 5*** | 118 | 56.4 | 35.3 | 1.8 | 1.0 | 94.5 |
| 6*** | 115 | 56.8 | 37.5 | 2.1 | 1.5 | 97.9 |

*Broken pieces 1" × 6" × 6"
**30 lb. pigs (6 ⅝ pigs)
***1' × 1' × 9" blocks

The term fluoride flux as used herein merely means a flux containing a fluoride compound and includes all of the fluxes or flux compositions set forth herein. The fluoride flux may be made up entirely of fluoride compounds such as cryolite or other aluminum fluorides or may be made up of a fluoride compound and other suitable fluxing compounds; for example, alkali metal chlorides.

The foregoing disclosure and description of the invention is illustrative and explanatory thereof and various changes can be made within the scope of the appended claims, without departing from the spirit of the invention.

What is claimed is:

1. A method of processing an impure molten aluminum base alloy containing at least about 23 percent silicon and at least about 1.6% titanium, which method includes the step of adding to the molten alloy a solid or granular fluoride flux less dense than the alloy and having a boiling point above the alloy's liquidus temperature and in a sufficient amount to effectively reduce the titanium content of the alloy, then permitting the mixture to stand to settle out a molten alloy in which the titanium content is reduced but not entirely eliminated, and separating the settled out alloy from the flux.

2. The method of claim 1, in which the flux is essentialy one of the following:

a. cryolite, b. a combination of an aluminum fluoride with one or more salts of an alkali metal having an atomic number of 3 to 19 and a halogen having an atomic number of 9 to 17, or c. a combination of cryolite with sodium chloride and/or potassium chloride.

3. The method of claim 1, wherein the temperature of the molten alloy is from about 1000° C–1200° C.

4. The method of claim 1, wherein the molten alloy is in a ladle at the area of a tap hole in a furnace from which the molten alloy has been removed.

5. The method of claim 1, wherein the ratio by weight of flux to alloy is about 1:1.

6. The method of claim 1, wherein the ratio by weight of flux to alloy is about 0.2:1.

7. The method of claim 1, wherein a similar second fluxing treatment is performed while the alloy is in a molten condition in a ladle in an area removed from a tap hole area adjacent a furnace from which the molten alloy has been removed therefrom via a tap hole in the furnace.

* * * * *